US012569023B2

(12) United States Patent
Fiegener

(10) Patent No.: US 12,569,023 B2
(45) Date of Patent: Mar. 10, 2026

(54) ADJUSTABLE HELMET LINER SYSTEM

(71) Applicant: Tool Manufacturing, Inc., Marblehead, MA (US)

(72) Inventor: John D. Fiegener, Marblehead, MA (US)

(73) Assignee: Tool Manufacturing, Inc., Marblehead, MA (US)

( * ) Notice: Subject to any disclaimer, the term of this patent is extended or adjusted under 35 U.S.C. 154(b) by 0 days.

(21) Appl. No.: 19/042,931

(22) Filed: Jan. 31, 2025

(65) Prior Publication Data

US 2025/0241398 A1 Jul. 31, 2025

Related U.S. Application Data

(60) Provisional application No. 63/627,742, filed on Jan. 31, 2024.

(51) Int. Cl.
*A42B 3/10* (2006.01)
*A42B 3/14* (2006.01)

(52) U.S. Cl.
CPC ..... *A42B 3/10* (2013.01); *A42B 3/14* (2013.01); *A42B 3/145* (2013.01); *A42B 3/147* (2013.01)

(58) Field of Classification Search
CPC .. A42B 3/10; A42B 3/14; A42B 3/145; A42B 3/147
See application file for complete search history.

(56) References Cited

U.S. PATENT DOCUMENTS 5,572,749 A * 11/1996 Ogden ..... G09B 9/307 2/418
5,575,017 A * 11/1996 Hefling ..... A42B 3/145 2/418
6,159,324 A * 12/2000 Watters ..... A42C 2/00 264/553
10,588,374 B2 * 3/2020 Maloney ..... A42B 3/145
11,357,279 B2 * 6/2022 Cotterman ..... A42B 3/064
11,457,684 B2 * 10/2022 Maloney ..... A42B 3/145
2013/0283507 A1 * 10/2013 Baty ..... A42B 3/14 2/416
2017/0273390 A1 * 9/2017 Maloney ..... A42B 3/142
2020/0253315 A1 * 8/2020 Maloney ..... A42B 3/142
2020/0383416 A1 * 12/2020 Miller ..... A42B 3/145
2021/0100309 A1 * 4/2021 Maloney ..... F16B 5/0642
2021/0153594 A1 * 5/2021 Rogers ..... A42B 3/085
2025/0241398 A1 * 7/2025 Fiegener ..... A42B 3/10

FOREIGN PATENT DOCUMENTS

WO WO-2017111977 A1 * 6/2017 ..... A42B 3/142
WO WO-2020247737 A1 * 12/2020 ..... A42B 3/145

* cited by examiner

*Primary Examiner* — Khaled Annis
(74) *Attorney, Agent, or Firm* — Coffield Heedy Kilgore PLLC; William G. Heedy

(57) ABSTRACT

A helmet liner has a central spine, a front panel, and a plurality of arms. First and second side rails each form at least one track. Each of the arms are integrated with the at least one track on one of the first or second side rails. The first end of first and second side rails is secured to the front panel. The second end of each of the first and second side rails forms a cable return channel. Selective lengthening and shortening of first and second loops of cable integrated with a dial system, each loop of the cable being fed through a respective one of the cable return channels at the second end of the first side rail and the second side rail, permits the helmet liner to loosen or causes the helmet liner to tighten, respectively.

20 Claims, 3 Drawing Sheets

ADJUSTABLE HELMET LINER SYSTEM

REFERENCE TO RELATED APPLICATION

This application claims priority to U.S. Provisional Patent Application Ser. No. 63/627,742 filed on Jan. 31, 2024, entitled "Adjustable Helmet Liner System", the disclosure and drawings of which are hereby incorporated herein in their entirety by reference.

FIELD OF THE INVENTION

The invention relates to helmet liners and, more particularly, an adjustable helmet liner system including a single layer liner having a plurality of arms each being engaged along opposing side rails, and a dial system for selectively increasing and decreasing the tension of the integrated cable applied along the side rails and front panel of the single layer liner to tighten and loosen the helmet liner about the wearer's head.

BACKGROUND

The significance of a properly fitting helmet cannot be overstated, as it directly correlates with the fundamental aspects of user safety and comfort. A helmet that fits snugly and conforms to the contours of an individual's head not only provides a secure protective barrier but also ensures optimal functionality in mitigating the impact of potential accidents or collisions. Beyond safety, a well-fitted helmet contributes significantly to user comfort during prolonged wear. Discomfort or distraction resulting from an ill-fitting helmet can compromise the focus and attention of the wearer, potentially leading to unsafe conditions. Therefore, the implementation of helmet fit systems plays a pivotal role in enhancing both the protective and ergonomic qualities of helmets, ultimately fostering a safer and more comfortable experience for the wearer.

Various helmet liner fitting mechanisms integrate some form of a lace tightening system forming part of a helmet liner, thereby permitting the helmet liner to be tightened and loosened to more precisely fit the configuration of a wearer's head, ensuring a snug and comfortable fit for the helmet liner. One common issue with such helmets is the relatively high amount lace (or cable) that is exposed and/or guided throughout various portions of the helmet liner, which results in an increased likelihood of malfunction.

SUMMARY

In accordance with one form of the invention, there is provided a helmet liner for a wearer's head, the helmet liner including a central spine; a front panel; a plurality of arms; each one of the plurality of arms having a distal end; wherein the central spine, the front panel and the plurality of arms are a unitary structure formed of a durable material; a first side rail and a second side rail, each forming at least one track and each having a first end and a second end; a distal end of each one of the plurality of arms forming a guide member slidably integrated with the at least one track on one of the first side rail or the second side rail; the first end of each of the first side rail and the second rail being secured to the front panel; the second end of each of the first side rail and the second side rail forming a cable return channel; a cable; a dial system being structured and disposed for selectively lengthening and shortening a first loop of the cable and a second loop of the cable, each being fed through a respective one of the cable return channels at the second end of the first side rail and the second side rail; wherein, as the first and second loops of the cable are selectively shortened using the dial system, the loops of the cable pull each of the first and second side rails about the respective cable return channels, thereby causing each track to move along the respective guide members as the side rails are pulled closer to the dial system, transmitting a force for pulling the front panel and plurality of arms, thereby tightening the helmet liner about the wearer's head; and wherein, as the loops of the cable are selectively lengthened, the loops of the cable decrease tension about the respective cable return channels, thereby permitting each track to move along the respective guide members as the side rails move away from the dial system, causing the front panel and plurality of arms to loosen about the wearer's head.

In accordance with another form of the invention, there is provided a helmet liner for a wearer's head, including a central spine; a front panel; a plurality of arms; each one of the plurality of arms having a distal end; a first side rail and a second side rail, each forming at least one track and each having a first end and a second end; a distal end of each one of the plurality of arms being integrated with the at least one track on one of the first side rail or the second side rail; the first end of each of the first side rail and the second rail being secured to the front panel; the second end of each of the first side rail and the second side rail forming a cable return channel; a cable; and a dial system being structured and disposed for selectively lengthening and shortening a first loop of the cable and a second loop of the cable, each being fed through a respective one of the cable return channels at the second end of the first side rail and the second side rail, for loosening and tightening the helmet liner, respectively.

In accordance with another form of the invention, there is provided a helmet liner for a wearer's head, including a central spine; a front panel; a plurality of arms; each one of the plurality of arms having a distal end; a first side rail and a second side rail, each forming at least one track and each having a first end and a second end; a distal end of each one of the plurality of arms being integrated with the at least one track on one of the first side rail or the second side rail; the first end of each of the first side rail and the second rail being secured to the front panel; the second end of each of the first side rail and the second side rail forming a cable return channel; a cable; and wherein, selectively lengthening and shortening a first loop of the cable and a second loop of the cable, each being fed through a respective one of the cable return channels at the second end of the first side rail and the second side rail, permits the helmet liner to loosen or causes the helmet liner to tighten, respectively.

BRIEF DESCRIPTION OF THE DRAWINGS

For a fuller understanding of the nature of the present invention, reference should be made to the following detailed description, taken in conjunction with the accompanying drawings in which.

Like reference numerals refer to like reference parts throughout the several views of the drawings

DETAILED DESCRIPTION

An adjustable, single layer liner system for a helmet is disclosed.

Figure 1:
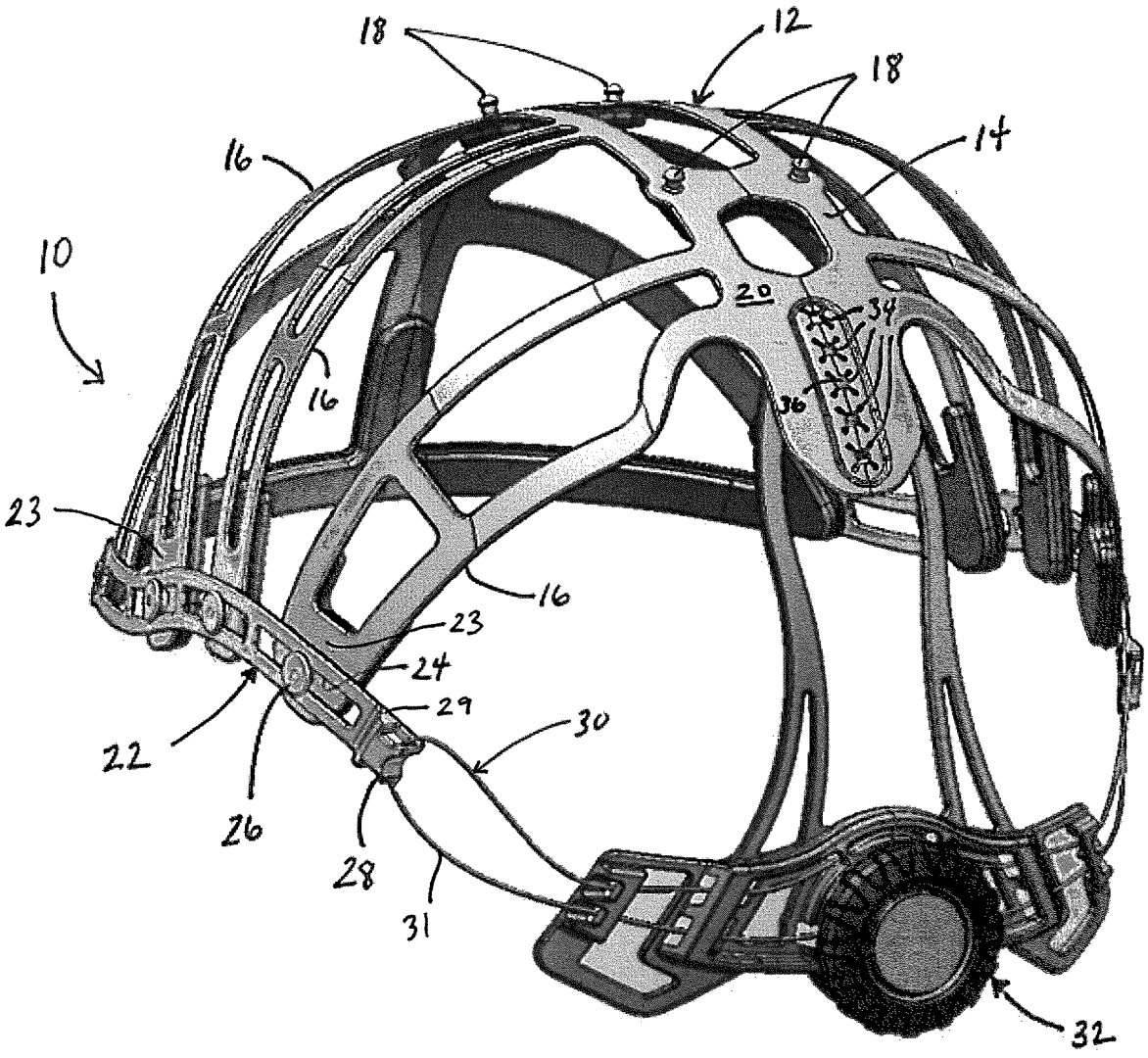
FIG. 1 is a perspective view of the rear side of an adjustable helmet liner system.

FIG. 1 is a perspective view of the rear side of an adjustable helmet liner system 10 according to one embodiment. A helmet liner 12 includes a central spine 14 and plurality of arms 16 extending therefrom. In a preferred embodiment, the helmet liner 12 is formed as a single layer. At least one snap basket receiver 18 is located on a top-facing surface 20 of the central spine 14. The at least one snap basket receiver 18 is provided for attachment with the interior surface of a helmet (not pictured). First and second side rails 22 are integrated with the plurality of arms 16 at the distal end 23 of each of the plurality of arms 16. At least one track 24 is formed along each side rail 22. Each track 24 is sized and configured for engaged receipt of one or more guide members 26 formed on each respective arm 16. Each side rail 22 forms a cable return channel 28 at a first end 29 of the side rail 22, the cable return channel having a curved surface against which a cable 30 applies tension as selectively determined by a user operating a dial system 32. The combination of the side rails 22, the cable return channel 28 and the dial system 32 collectively provide for an overall helmet liner fit system that has minimal cable exposure, as only minor portions of the cable 30 are exposed in the form of loops 31 of cable 30. The dial system 32 is attached to the liner 12 via a plurality of rear snap openings 34 formed on the central spine 14, each being sized to receive a protrusion 36 formed on the dial system 32.

Figure 2:
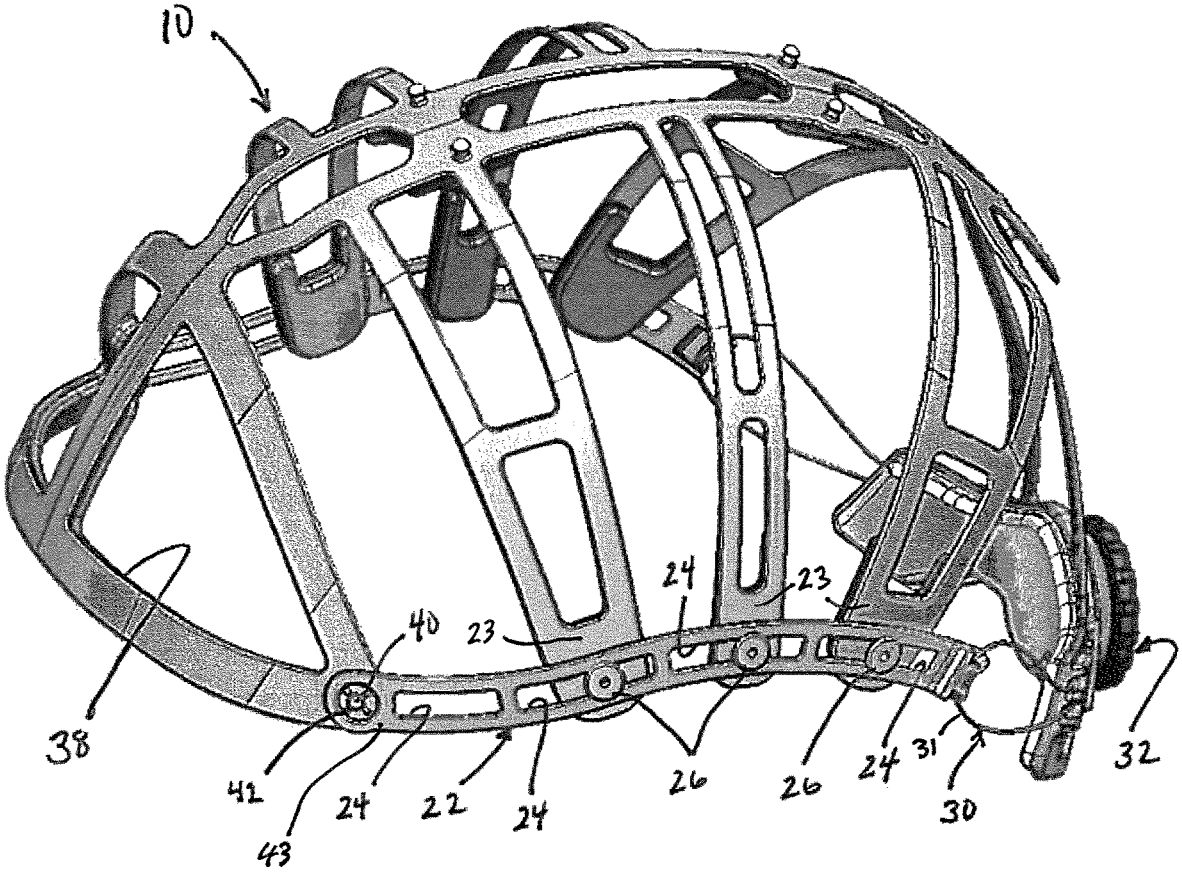
FIG. 2 is a perspective view of the front side of the adjustable helmet liner system.

FIG. 2 is a perspective view of the front side of the adjustable helmet liner system 10. Front panel 38 forms the front of the helmet liner 12 and is configured to be in abutment with a portion of a wearer's head, namely, the wearer's forehead. A post 40 is formed on each opposing side of the front panel 38. Each post 40 is sized for engaged receipt by a front snap opening 42 formed on each side rail 22 at a second end 43 of side rail 22. The side rail 22 is structured and disposed to pivot about the post 40 at the front snap opening 42 in response to the amount of tension selectively applied by a user operating a dial system 32.

Figure 3:
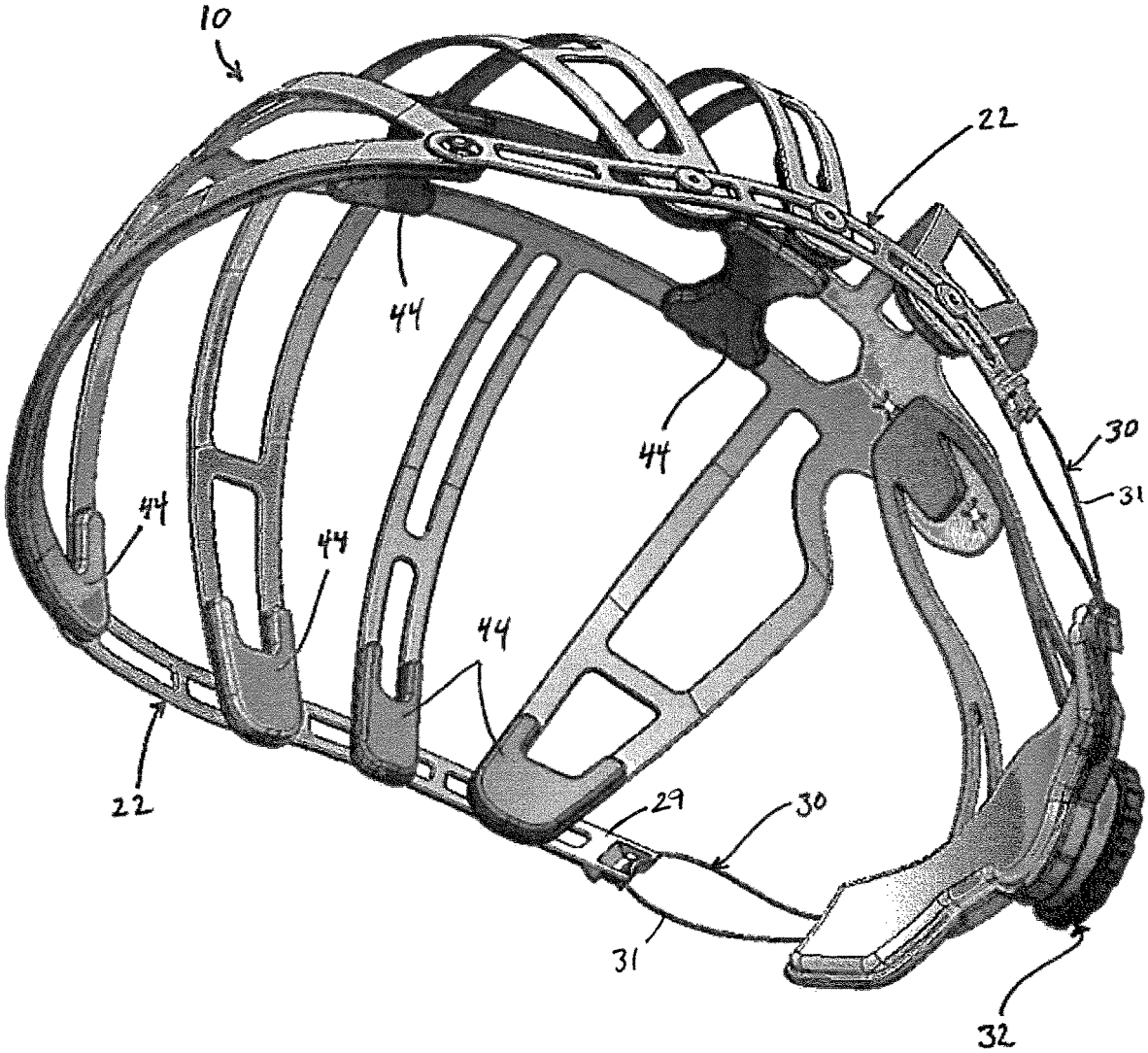
FIG. 3 is a perspective view of the bottom side of the adjustable helmet liner system.

FIG. 3 is a perspective view illustrating the bottom side of the adjustable helmet liner system 10. A plurality of pads 44 are affixed to the bottom-facing surface 46 of the helmet liner 12, including along the central spine 14 and on the arms 16. The pads 44 may be affixed to the bottom-facing surface 46 using standard attachment means, such as hook and loop fasteners.

In operation, the dial system 32 is selectively operated by a wearer to lengthen or shorten the exposed loops 31 of cable 30. As the loops 31 of cable 30 are shortened, the loops 31 of cable 30 pull each side rail 22 about the respective cable return channels 28, thereby causing each track 24 to move along the respective guide members 26 as the side rails 22 are pulled closer to the dial system 32, causing the front panel 38 and plurality of arms 16 to be pulled, as well, thereby tightening the helmet liner 12. Conversely, as the loops 31 of cable 30 are lengthened, the loops 31 of cable 30 decrease tension about the respective cable return channels 28, thereby permitting each track 24 to move along the respective guide members 26 as the side rails 22 move away from the dial system 32, causing the front panel 38 and plurality of arms 16 to loosen.

In an embodiment, each side rail 22 is slightly undulating for purposes of conforming with the arms 16, which, in turn, conform to the shape of a wearer's head. In an embodiment, the tracks 24 are slightly undulating for smooth tightening and loosening of the helmet liner system 10.

In an embodiment, the center central spine 14, plurality of arms 16 and front panel 38 are unitary, that is, a single molded piece formed of a durable material, such as plastic.

In an embodiment, the cable 30 is formed from 0.7 millimeter nylon filament.

In an embodiment, the total weight of the adjustable helmet liner system is 10 grams.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations may be well known in the art, and because they do not facilitate a better understanding of the present disclosure, a discussion of such elements and operations is not provided herein. The present disclosure is deemed to inherently include all such elements, variations, and modifications to the described aspects that would be known to those of ordinary skill in the art, particularly in view of reading the present disclosure. Any headings used herein are for organizational purposes only and are not meant to be used to limit the scope of the description or the claims.

The terminology used herein is for the purpose of describing particular example embodiments or implementations only and is not intended to be limiting. As used herein, the singular forms "a", "an", and "the" may be intended to include the plural forms as well, unless the context clearly indicates otherwise.

The terms "comprises," "comprising," "includes," "including," "has," "having," and variations in form thereof are inclusive or variations in form thereof are intended to be inclusive in a manner similar to the term "comprises" as that term is interpreted when employed as a transitional word in a claim, and therefore specify the presence of stated features, integers, steps, operations, elements, and/or components, but do not preclude the presence or addition of one or more other features, integers, steps, operations, elements, components, and/or groups thereof unless explicitly stated otherwise or the context clearly requires otherwise.

The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments and implementations.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments and implementations are contemplated, described herein, and set forth in the claims.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

The terms "includes," "has," "having," or "exhibits," or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items.

As used herein, phrases such as "between X and Y" and "between about X and Y" should be interpreted to include X and Y unless expressly stated otherwise or the context clearly indicates otherwise.

Terms such as "about", "approximately", "around", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While terms such as vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments and implementations preferably or optionally include certain features, elements and/or steps, while some other embodiments and implementations optionally do not include those certain features, elements and/or steps. Thus, such conditional language indicates, in general, that those features, elements and/or steps are used in a permissive sense rather than a mandatory sense, and may not be required for every implementation or embodiment.

The subject matter described herein is provided by way of illustration only and should not be construed as limiting the nature and scope of the claims herein. While different embodiments and implementations have been provided above, it is not possible to describe every conceivable combination of components or methodologies for implementing the disclosed subject matter, and one of ordinary skill in the art may recognize that further combinations and permutations that are possible. Furthermore, the nature and scope of the claims is not necessarily limited to implementations that solve any or all disadvantages which may have been noted in any part of this disclosure. Various modifications and changes may be made to the subject matter described herein without departing from the spirit and scope of, the exemplary embodiments, implementations, and applications illustrated and described herein.

Although the subject matter presented herein has been described in language specific to components used therein, it is to be understood that the scope of the claims is not necessarily limited to the specific components or characteristics thereof described herein; rather, the specific components and characteristics thereof are disclosed as example forms of implementing the disclosed subject matter. Accordingly, the disclosed subject matter is intended to embrace all alterations, modifications, and variations, that fall within the scope and spirit of any claims included herein or that may be written.

The foregoing description and figures are intended only to convey to a person having ordinary skill in the art the fundamental aspects of the disclosed subject matter and are not intended to limit, and should not be construed as limiting, the scope of any present or future claims. Further, in the foregoing Detailed Description, various features may be grouped together in a single embodiment or implementation for the purpose of streamlining the disclosure. This method of disclosure is not to be interpreted as reflecting an intention that a claimed embodiment, implementation, or application requires more features than are expressly recited in a present or future claim. Rather, present and future claims reflect patentable subject matter which may lie in less than all features of a single disclosed embodiment, implementation, or application.

The invention claimed is:

1. A helmet liner for a wearer's head, comprising:

a central spine;

a front panel;

a plurality of arms; each one of the plurality of arms having a distal end;

wherein the central spine, the front panel and the plurality of arms are a unitary structure formed of a durable material;

a first side rail and a second side rail, each forming at least one track and each having a first end and a second end;

a distal end of each one of the plurality of arms forming a guide member slidably integrated with the at least one track on one of the first side rail or the second side rail;

the first end of each of the first side rail and the second rail being secured to the front panel;

the second end of each of the first side rail and the second side rail forming a cable return channel;

a cable;

a dial system being structured and disposed for selectively lengthening and shortening a first loop of the cable and a second loop of the cable, each being fed through a respective one of the cable return channels at the second end of the first side rail and the second side rail;

wherein, as the first and second loops of the cable are selectively shortened using the dial system, the loops of the cable pull each of the first and second side rails about the respective cable return channels, thereby causing each track to move along the respective guide members as the side rails are pulled closer to the dial system, transmitting a force for pulling the front panel and plurality of arms, thereby tightening the helmet liner about the wearer's head; and wherein, as the loops of the cable are selectively lengthened, the loops of the cable decrease tension about the respective cable return channels, thereby permitting each track to move along the respective guide members as the side rails move away from the dial system, causing the front panel and plurality of arms to loosen about the wearer's head.

2. The helmet liner as recited in claim 1 wherein the durable material is plastic.

3. The helmet liner as recited in claim 1 wherein the cable is formed from 0.7 millimeter nylon filament.

4. The helmet liner as recited in claim 1 wherein each side rail is slightly undulating.

5. The helmet liner as recited in claim 1 wherein the at least one track on each side rail is slightly undulating.

6. The helmet liner as recited in claim 1 wherein the weight of the adjustable helmet liner system is approximately 10 grams.

7. A helmet liner for a wearer's head, comprising:

a central spine;

a front panel;

a plurality of arms; each one of the plurality of arms having a distal end;

a first side rail and a second side rail, each forming at least one track and each having a first end and a second end;

a distal end of each one of the plurality of arms being integrated with the at least one track on one of the first side rail or the second side rail;

the first end of each of the first side rail and the second rail being secured to the front panel;

the second end of each of the first side rail and the second side rail forming a cable return channel;

a cable; and a dial system being structured and disposed for selectively lengthening and shortening a first loop of the cable and a second loop of the cable, each being fed through a respective one of the cable return channels at the second end of the first side rail and the second side rail, for loosening and tightening the helmet liner, respectively.

8. The helmet liner as recited in claim 7 wherein the central spine, the front panel and the plurality of arms are a unitary structure formed of a durable material.

9. The helmet liner as recited in claim 7 wherein the durable material is plastic.

10. The helmet liner as recited in claim 7 wherein the cable is formed from 0.7 millimeter nylon filament.

11. The helmet liner as recited in claim 7 wherein each side rail is slightly undulating.

12. The helmet liner as recited in claim 7 wherein the at least one track on each side rail is slightly undulating.

13. The helmet liner as recited in claim 7 wherein the weight of the adjustable helmet liner system is approximately 10 grams.

14. A helmet liner for a wearer's head, comprising:

a central spine;

a front panel;

a plurality of arms; each one of the plurality of arms having a distal end;

a first side rail and a second side rail, each forming at least one track and each having a first end and a second end;

a distal end of each one of the plurality of arms being integrated with the at least one track on one of the first side rail or the second side rail;

the first end of each of the first side rail and the second rail being secured to the front panel;

the second end of each of the first side rail and the second side rail forming a cable return channel;

a cable; and wherein, selectively lengthening and shortening a first loop of the cable and a second loop of the cable, each being fed through a respective one of the cable return channels at the second end of the first side rail and the second side rail, permits the helmet liner to loosen or causes the helmet liner to tighten, respectively.

15. The helmet liner as recited in claim 14 wherein the central spine, the front panel and the plurality of arms are a unitary structure formed of a durable material.

16. The helmet liner as recited in claim 14 wherein the durable material is plastic.

17. The helmet liner as recited in claim 14 wherein the cable is formed from 0.7 millimeter nylon filament.

18. The helmet liner as recited in claim 14 wherein each side rail is slightly undulating.

19. The helmet liner as recited in claim 14 wherein the at least one track on each side rail is slightly undulating.

20. The helmet liner as recited in claim 14 wherein the weight of the adjustable helmet liner system is approximately 10 grams.

* * * * *